United States Patent [19]

Leblanc et al.

[11] 4,411,556

[45] Oct. 25, 1983

[54] BARGE BUMPER CONSTRUCTION

[75] Inventors: Raymond F. Leblanc, North Canton; William T. Cummins, Mogadore, both of Ohio

[73] Assignee: Teledyne Industries, Inc., Los Angeles, Calif.

[21] Appl. No.: 258,567

[22] Filed: Apr. 29, 1981

[51] Int. Cl.[3] ..... E02B 3/22

[52] U.S. Cl. ..... 405/213; 405/211; 114/220

[58] Field of Search ..... 405/211–215; 188/322.17, 322.19; 114/219, 220; 267/1

[56] References Cited

U.S. PATENT DOCUMENTS

| | | | |
|---|---|---|---|
| 3,145,685 | 8/1964 | Kulick | 114/220 |
| 3,863,740 | 2/1975 | Kinman | 188/322.17 |
| 3,873,076 | 3/1975 | Evans | 405/215 X |
| 3,991,582 | 11/1976 | Waldrop et al. | 405/213 |
| 4,005,672 | 2/1977 | Files | 114/219 |
| 4,098,211 | 7/1978 | Files et al. | 114/220 X |
| 4,109,474 | 8/1978 | Files et al. | 405/213 |
| 4,293,241 | 10/1981 | Helveston et al. | 405/213 |

*Primary Examiner*—Dennis L. Taylor

*Attorney, Agent, or Firm*—Frease & Bishop

[57] ABSTRACT

A bumper construction for offshore oil rig structures in which an upright metal bumper pipe member of considerable length is encased or sheathed loosely with a tubular rubber enclosure rotatable on the pipe member. The tubular enclosure is formed by a series of rubber sleeves telescoped over and stacked on the upright pipe. Each sleeve has three integrally vulcanized layers of elastomeric materials which have physical properties different one from those of each other layer. The different elastomeric materials are present in predetermined percentages by weight. Each sleeve has a length substantially greater than its inner diameter and preferably more than two times its inner diameter. The sleeves have interfitting conical formations at adjacent ends when stacked.

6 Claims, 2 Drawing Figures

BARGE BUMPER CONSTRUCTION

BACKGROUND OF THE INVENTION

1. Field of the Invention

The invention relates to energy-absorbing bumpers mounted on legs or other structural members of oil rig platforms, barge loading docks or similar structures to fend off vessels from or to rig structures or barges or other floating vessels which may be berthed at the rig structures from damage which can result from relative motion between a floating vessel and a rig structure as a result of wave action.

More particularly the invention relates to a new rubber bumper cushion sleeve construction rotatably mounted in a stacked series of sleeves on a typical usually vertical bumper pipe member which is supported outboard in any usual manner on a platform leg or other similar structural member.

Further, the invention relates to a series of rubber sleeve members stacked in an interfitting manner and rotatably mounted on a vertical metal bumper pipe member and to the particular dimensional and constituent materials construction and content of such sleeve members to provide an outer abrasion or tear resistant contact surface, an inner hard, load supporting layer, which may have a relatively low friction surface and an internal annular soft energy-absorbing body portion.

2. Description of the Prior Art

There have been a great variety of types of prior barge bumpers wherein the vertical metal pipe member has a stack of used automobile or other vehicle tires rotatably mounted on the pipe member between top and bottom pipe member supports. Such stacked tire bumpers are characterized by deficiencies in that the bumper may be engaged by a boat rib which forces its way in between two adjacent tires, and during wave action such engagement may rip one or more of the tires off of the bumper pipe member requiring repairs for the bumper and replacement of tires.

These deficiencies in stacked tire bumpers have been sought to be overcome by replacing the tires using specially molded tire-substitute doughnutlike disks or rings having 9" to 12" axial thickness and having special configurations to permit rotative mounting on the bumper pipe member, such rings having flat ends and outer diameters considerably larger than the axial ring thickness. Examples of such specially mounted energy-absorbing bumper rings are shown in U.S. Pat. Nos. 3,145,685, 3,873,076, 3,991,582, 4,005,672, 4,098,211 and 4,109,474.

Problems that have been encountered in the use of such special energy-absorbing flat ended large diameter tire replacement rings have led to the use of a continuous molded rubber pipe having an internal diameter larger than the outer diameter of the metal bumper pipe and having a length approximating that of the metal bumper pipe telescoped over, surrounding and rotatably mounted on the metal bumper pipe. Such protective rubber pipes may, for example, be 20 feet long.

Such energy-absorbing rubber pipe members avoid the difficulties encountered with other forms of rubber tires or rubber rings stacked on the metal pipe member described; but when such long rubber pipe members may fail or be torn or otherwise damaged by rubbing abrasion from the ribs of a barge or other floating vessel, extremely high cost replacement procedures are involved.

That is to say, the bumper must be dismantled at least at its upper end from its support on the rig structure so that the damaged rubber pipe can be telescopically removed from the upper end of the bumper metal pipe and a new rubber pipe telescoped onto the metal pipe from the top. Such replacement requires the use of heavy handling equipment to accommodate the weight and long length of the rubber pipes being removed and replaced.

Accordingly, there is an existing need and a long standing want in the field of barge bumpers for offshore oil rigs for a rubber bumper construction which may be rotatably mounted on a vertical oil rig metal pipe member which avoids the difficulties heretofore encountered with prior devices and which functions in an efficient and reliable manner to resist abrasion, to rotate easily on the bumper pipe, and to cushion forces to which the bumper is subjected by barges, boats and their ribs when berthed at an offshore rig structure and moving relatively with respect to the rig structure, for example, due to wave action.

SUMMARY OF THE INVENTION

Objectives of the invention include providing a new energy-absorbing rubber bumper sleeve construction in which a series of such sleeves are stacked and rotatably mounted on the entire length of a metal bumper pipe member and in which the sleeves have interfitting formations at their ends; providing such new rubber bumper sleeve construction in which the sleeves have an axial length substantially exceeding at least the inner diameter thereof; providing such a new rubber bumper sleeve construction in which the sleeve body in cross section is composed of a series of annular integrated layers of rubber containing material having characteristics of a hard, load supporting inner layer having a low friction interior annular sleeve surface, an abrasion and tear resistant annular sleeve outer contact surface and an intervening soft rubber energy-absorbing annular body portion; providing such new rubber bumper sleeve construction in which the inner sleeve diameter is larger than the outer diameter of the metal bumper pipe to provide clearance for relative rotative movement of the sleeve around the metal pipe member and in which the upper end of at least the upper sleeve of a series of sleeves stacked on and rotatably mounted on the metal bumper pipe member has an annular inturned flexible lip thereon closing the annular clearance space between the sleeve and metal pipe member at the top of the sleeve assembly to prevent possible injury of platform or boat-tending personnel; and providing a new rubber bumper sleeve construction which achieves the stated objectives in a reliable, efficient and easily used manner and which solves problems and satisfies needs that long have existed in the construction of bumper devices on offshore oil rig structures.

These and other objectives and advantages may be obtained by the new rubber bumper sleeve construction and assembly, the general nature of which is set forth below and may be stated as including an elastomeric sleeve member for loose telescopic assembly on the vertical pipe member of a bumper device for an offshore oil rig structure having a cylindrical sleeve body having upper and lower ends; the body having inner, intermediate, and outer elastomeric material layers integrally cross-linked together; the cylindrical body having a length substantially greater than its inner diameter; the elastomeric materials forming the inner, intermediate, and outer integrally cross-linked layers each having physical properties different from those of each of the other layers; and a plurality of such sleeve members being adapted to be stacked one on another telescopically on an offshore oil rig bumper pipe member to provide an energy-absorbing rotatable protective cushioning sheath on such pipe member.

BRIEF DESCRIPTION OF THE DRAWINGS

A preferred embodiment of the invention—illustrative of the best mode in which applicants have contemplated applying the principles—is set forth in the following description and shown in the drawings and is particularly and distinctly pointed out and set forth in the appended claims.

Similar numerals refer to similar parts throughout the various figures of the drawings.

DESCRIPTION OF THE PREFERRED EMBODIMENT

Figure 1:
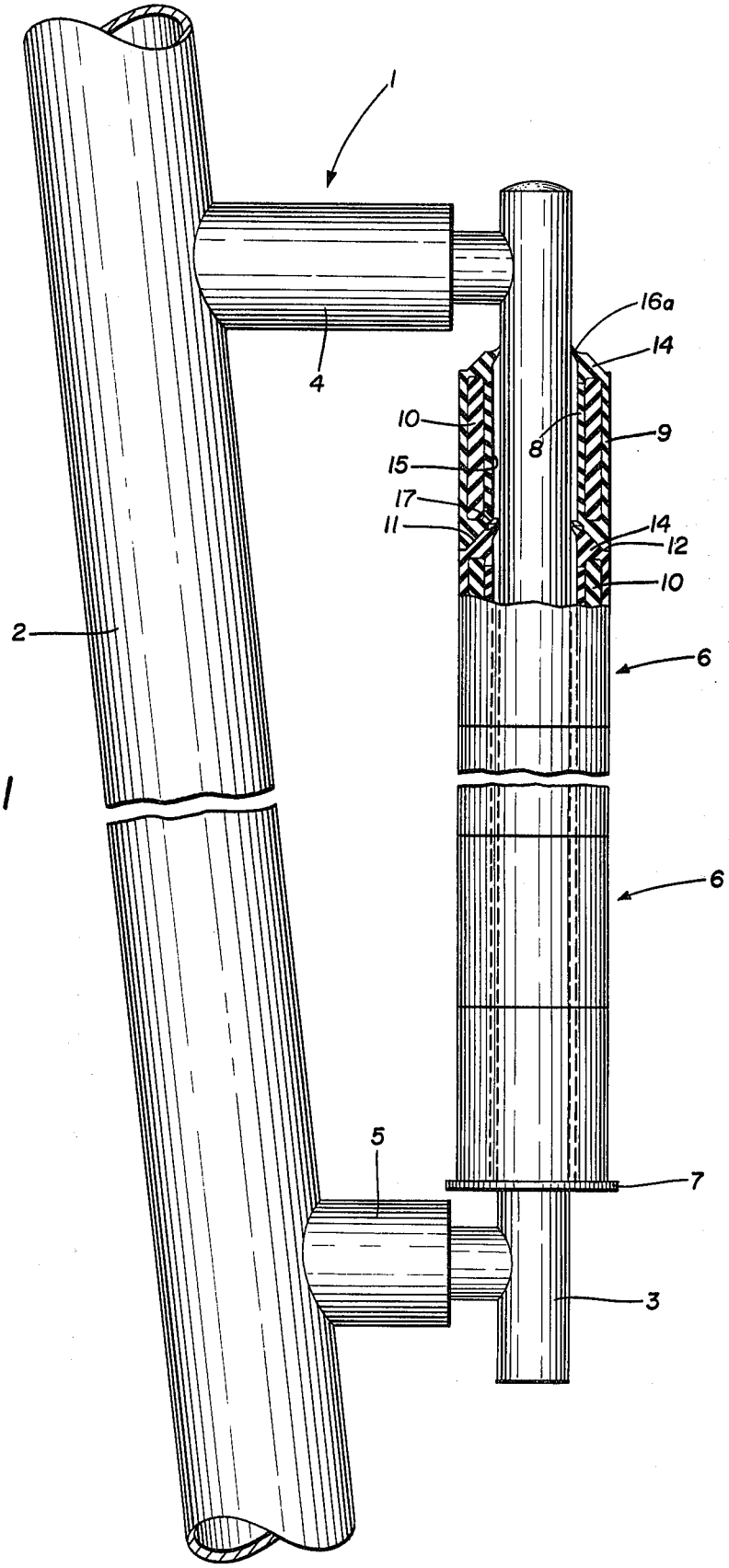
FIG. 1 is a somewhat diagrammatic view of a typical oil rig bumper mounted on a leg of a platform structure having the new rubber bumper sleeve construction mounted on the vertical metal bumper pipe member.

A typical barge bumper structure generally indicated at 1 is shown in FIG. 1 mounted on the leg 2 of a typical oil rig structure. The bumper 1 may have a vertical metal pipe member 3 supported by shock cells 4 and 5 connected with the leg 2. One or both of the connections between the pipe member 3 and shock cells 4 and 5 may be a separable connection, not shown, of any usual construction to permit access to at least one end of the pipe member 3 for replacement of rubber bumper sleeves thereon.

The improved rubber bumper sleeves, according to the concepts of the invention, are generally indicated at 6 rotatably mounted and stacked on the vertical pipe member 3 in FIG. 1, the lower sleeve 6 being supported on the flange 7 at the lower end of pipe 3 above the lower shock cell 5.

Figure 2:
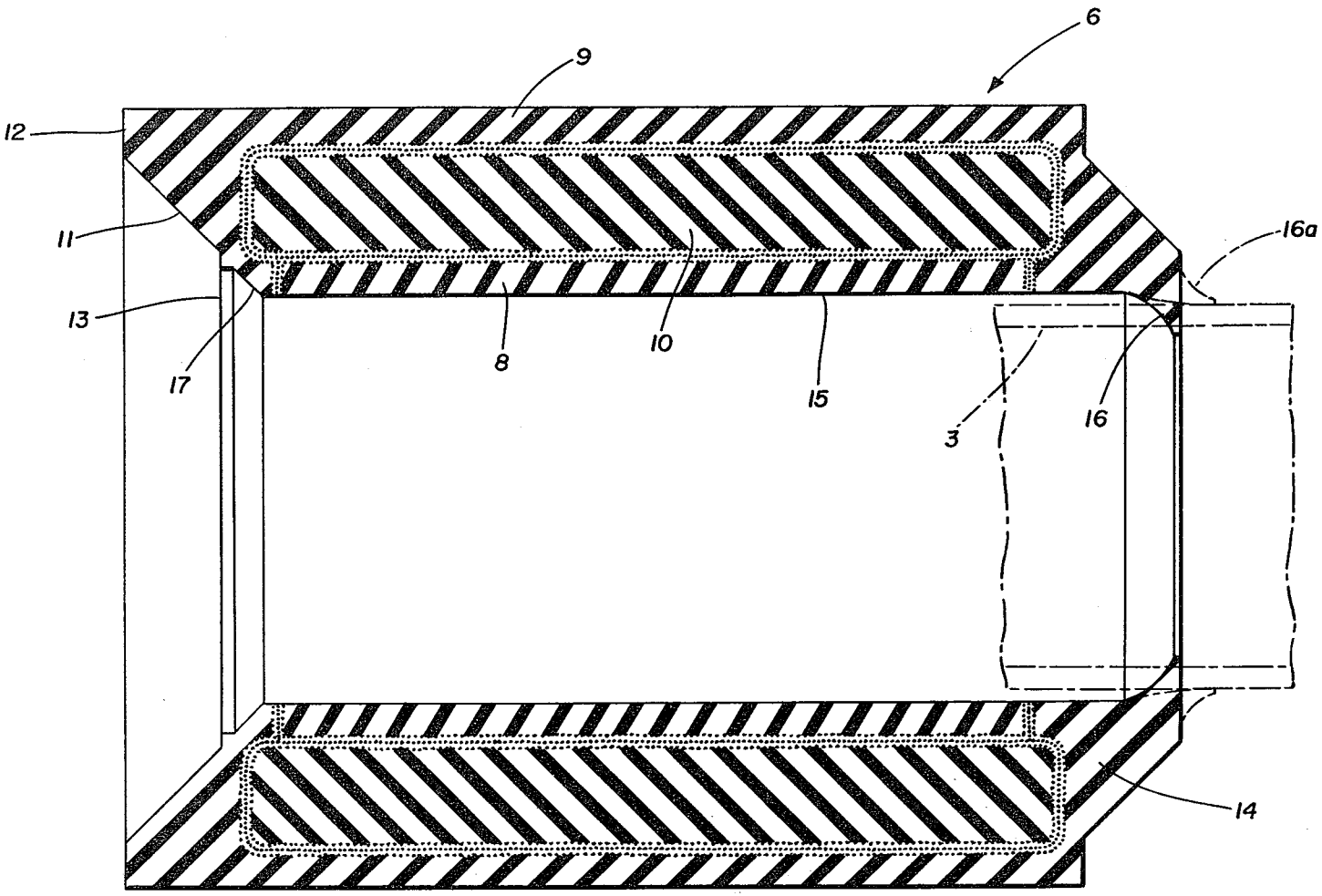
FIG. 2 is a greatly enlarged axial sectional view of the new rubber bumper sleeve construction.

FIG. 2 somewhat diagrammatically illustrates the construction and new characteristics, both as to shape and material content, of one of the sleeves 6. In cross section the bumper sleeve 6 comprises an inner annular layer 8, an outer annular layer 9 and an intermediate annular layer 10 sandwiched between the inner and outer layers 8 and 9. Each layer 8, 9 and 10 comprises a rubber material of different composition from those of the other layers. The sleeve 6 is molded and vulcanized in a usual manner to integrate the layers 8, 9 and 10 and cross-link, fuse, vulcanize or bond the same together where the different rubber compositions contact each other. Such bonds are indicated by stippling in FIG. 2.

One end of the sleeve as molded, which constitutes the lower end of any sleeve when mounted on the pipe member 3, has a zigzag shape including an annular conical surface 11 extending between axially spaced flat ringlike annular surfaces 12 and 13 located in planes normal to the axis of the sleeve. The other or upper end 14 of the sleeve 6 is molded to have an annular shape complementary to and adapted to interfit with the shape of the annular surfaces 11, 12, and 13, formed at the lower end of another sleeve, so that when multiple sleeves 6 are stacked one on another as shown in FIG. 1, the interfitting ends prevent a readily entered space between adjacent sleeves for a boat or vessel rib to enter and damage the sleeves.

In accordance with the invention, the inner annular sleeve layer 8 is formed of "cracked friction" known in the art by that name and comprises a rubber impregnated fabric in its uncured or unvulcanized state. When molded to form the sleeve 6 the layer 8 material is hard, and resists axial compression forces and may have a relative low coefficient of friction and thus a sleeve 6 readily rotates on the pipe 3 when contacted by a moving vessel.

The intermediate annular rubber layer 10 is formed of a soft, #40 to #50 Shore A Durometer rubber. Such a soft rubber layer within the body of the sleeve 6 provides excellent energy-absorbing characteristics for the sleeve.

The outer annular layer 9 of the sleeve 6 is formed of a #60 to #70 Shore A Durometer rubber to provide a high quality abrasion and tear resistant contact surface for the sleeve 6. This abrasion and tear resistant contact surface is an important feature of the invention in resisting damage to the sleeves 6 from continuous rubbing by vessels and vessel ribs moving as a result of wave action with respect to the bumper when moored at an offshore rig equipped with the improved bumper. Each of the rubber compositions of layers 9 and 10 may be formed of natural or synthetic rubber or blends thereof.

The improved sleeve 6 may be molded in a usual manner in a two-piece mold forming a cavity providing the outer shape of the sleeve and including a separable cylindrical mold core providing the axial opening 15 for the sleeve 6. The axial opening 15 is cylindrical throughout its length excepting that at the upper sleeve end 14 an annular inturned flexible lip or flap 16 preferably is formed as shown in FIG. 2, for a purpose described below.

In molding a sleeve 6 the various materials described from which the annular sleeve layers 8, 9 and 10 are formed are prepared separately in the usual manner as milled or calendered materials. Strips of the milled cracked friction material are wrapped about a mold core. Then much thicker and somewhat wider strips of the milled #40 to #50 Shore A Durometer rubber are wrapped over the strips of cracked friction material. Finally, even wider strips of the milled #60 to #70 Shore A Durometer material are wrapped around the two previously wrapped materials and then the core with the wrapped materials thereon is placed in the mold cavity, the mold is closed, and then is heated in a pot heater to carry out a usual vulcanizing operation.

The molded sleeve is then removed from the mold components and is constituted as shown in FIG. 2 with vulcanized bonds resulting within the rubber sleeve body between the various materials forming the three layers 8, 9 and 10 of the sleeve, the bonds being indicated diagrammatically by the stippled hatching.

Preferably the materials forming the various layers of the sleeve 6 have a relationship by weight approximating 50% for the soft energy-absorbing layer 10, 20% for the cracked friction layer 8 and 30% for the abrasion-resisting material outer layer 9.

A further dimensional relationship characterizes the sleeve 6. A typical metal bumper pipe member 3 may have an outer diameter of from 17" to 18". For installation on such a bumper pipe 3, the inner diameter of the sleeve 6 provided by the axial opening 15 preferably is from 1" to 2" larger than the diameter of the pipe 3, say 19" in diameter. This is to provide a clearance space between the sleeve and bumper pipe 3 when a series of sleeves 6 is stacked and installed thereon as indicated in FIG. 1.

This clearance space together with the low coefficient of friction characteristic of the inner surfaces of the sleeves 6 enhances ready rotation of the series of sleeves on the pipe 3 when contacted by a ship moving laterally across the bumper 1.

A sleeve 6, having an internal axial diameter of 19", preferably has a length of about four feet or 48" so that five sleeves 6 when stacked together as shown in FIG. 1, will provide an energy-absorbing sleeve surface and enclosure for a bumper pipe 3 having a length between shock cell mountings 4 and 5 therefor in excess of twenty feet.

The described sleeve may have an outer diameter of three feet or even more depending on the bumper requirements to be satisfied. Thus, the sleeve is substantially longer than its inner diameter and has a length in excess of two times its inner diameter.

In generally illustrating dimensional relationship in FIG. 1 the bumper is not limited to one having a twenty-foot length as it may have any desired length, represented by the broken lines in members 2 and 3.

Prior art bumper devices having a clearance of 1" to 2" in diameter between the interior of the rubber material surrounding the metal bumper pipe and the pipe 3 present a safety hazard in that, in one instance, a workman working on a platform with his hand at the upper end of the rubber material inserted in the clearance space had his hand cut off by an accidental collision at the time of a vessel with the bumper.

The annular flap 16 at the upper end of the upper sleeve 6 of the stack of sleeves shown in FIG. 1 as indicated, closes off the annular clearance space between the sleeves 6 and the pipe 3 to prevent such an injury from occurring. The manner in which the flap 16 functions is indicated somewhat diagrammatically in FIG. 2. The flap 16 is shown in full lines in the shape in which the sleeve 6 is molded. When a number of sleeves 6 are telescoped in a stack over a vertical bumper pipe member 3 (indicated by a fragmentary portion of a pipe 3 shown in dot-dash lines in FIG. 2), the annular flap 16 engages the pipe 3 and the pipe displaces the flap to the position shown in dot-dash lines at 16*a*. As previously indicated, the flap 16 of the top sleeve 6 in a stack thus closes off the clearance space between the interior of the sleeve 6 and the exterior of the pipe 3 to avoid the type of injury that has occurred with prior devices.

In order to accommodate the reshaped location 16*a* of the flap 16 when a series of sleeves 6 is stacked on a pipe member 3, the lower end of each sleeve has an annular tapered recess 17 which seats on the relocated flap 16*a* of the sleeve 6 next below in a stack thereof.

The improved sleeve construction of the sleeves 6 and a stack thereof as shown in FIG. 1 eliminates a large number of joints or crevices present in prior art devices where the energy-absorbing rubber casing for the pipe 3 is provided by tires which may be from 9" to 12" in axial thickness or provided by specially molded tire substitutes having similar thicknesses with flat surface joints between adjacent rings.

For example, in FIG. 1 there are only four joints between the five four-foot long sleeves forming a twenty-foot energy-absorbing casing on the bumper pipe 3 as compared with about twenty joints between tires or tire substitutes which may have an axial thickness of approximately one foot. Further, with the improved bumper construction the majority of the radial thickness of the interfitting ends between adjacent sleeves 6 is formed by tapered or conical surfaces. Thus, the very narrow flat joint portion at the annular surface 12 of the lower end of one sleeve where contacting a similar surface at the next adjacent sleeve that might be entered by the rib of a vessel minimizes the possibility of damage to the bumper.

Finally, when sleeve replacement may be required, the replacement maintenance operation for replacing one or more four-foot sleeves, involves simpler equipment and much less expense than when replacing a twenty-foot long rubber tube on the bumper pipe 3 from above or below or upon removal of the pipe 3 from the rig structure leg 2.

Accordingly, the new energy-absorbing bumper sleeve construction satisfies the stated objectives and solves problems and satisfies needs that have long existed in the art.

In the foregoing description, certain terms have been used for brevity, clearness and understanding; but no unnecessary limitations are to be implied beyond the requirements of the prior art because such terms are used for descriptive purposes and are intended to be broadly construed.

Moreover, the description and illustration of the invention is by way of example, and the scope of the invention is not limited to the exact details shown or described.

Having now described the features, discoveries, and principles of the invention, the manner in which the new bumper sleeves are manufactured, constructed, assembled and function; and the advantageous, new and useful results obtained; the new and useful structures, devices, components, elements, arrangements, parts, combinations, and relationships are set forth in the appended claims.

We claim:

1. An elastomeric sleeve member for loose telescopic assembly on a fixed vertical metal bumper pipe member of a bumper device for an offshore oil ring structure; comprising a cylindrical sleeve body having upper and lower ends; the body being formed of a plurality of elastomeric materials having different physical properties integrally cross-link bonded together; said plurality of elastomeric materials including an outer annular layer of #60 to #70 Shore A Durometer rubber providing an abrasion resistant annular sleeve outer contact surface, and a load supporting inner layer of cracked friction providing a relatively low friction interior annular sleeve surface rotatable on said fixed vertical metal bumper pipe member; the cylindrical body having a length in excess of two times its inner diameter, having an inner diameter in excess of 18 inches, and having a length of approximately 4 feet; and the upper and lower annular ends of the cylindrical sleeve body having complementary zigzag shapes in cross section including an annular conical surface extending between axially spaced flat ring annular surfaces located in planes normal to the axis of the sleeve body.

2. The sleeve construction defined in claim 1 in which the sleeve body inner diameter is about one inch larger than the outer diameter of a metal bumper pipe member over which the sleeve body is telescoped to provide clearance for relative rotative movement of the sleeve body around said pipe member.

3. The sleeve construction defined in claim 2 in which when the metal bumper pipe member has an outer diameter of from 17 inches to 18 inches, the sleeve body has an inner diameter of 19 inches to provide said clearance.

4. The sleeve construction defined in claim 3 in which an annular deformable lip projects circumferentially inward at the upper end of the cylindrical sleeve body adapted to engage the vertical pipe member of a bumper device on which said sleeve body is loosely telescopically assembled.

5. An energy-absorbing rotatable protective cushioning sheath for a fixed vertical pipe member of a bumper device for an offshore oil rig structure comprising a plurality of elastomeric sleeve members loosely telescoped over and stacked rotatably around such bumper pipe member; each sleeve member having a cylindrical sleeve body with upper and lower ends; each body being formed of a plurality of elastomeric materials having different physical properties integrally cross-link bonded together; said plurality of elastomeric materials including an outer annular layer of #60 to #70 Shore A Durometer rubber providing an abrasion-resistant annular sleeve outer contact surface, and a load-supporting inner layer of cracked friction providing a relatively low friction inner annular sleeve surface rotatable on said fixed vertical metal bumper pipe member; each cylindrical body having a length in excess of two times its inner diameter, having an inner diameter in excess of 18 inches, and having a length of approximately 4 feet; the upper and lower annular ends of each cylindrical sleeve body having complementary zigzag shapes in cross section; and each zigzag shape including an annular conical surface extending between axially spaced flat ring annular surfaces located in planes normal to the axis of the sleeve body; whereby the plurality of sleeve members have their complementary zigzag shapes interfitting with one another when the sleeve bodies are in stacked position.

6. The construction defined in claim 5 in which each sleeve body has an annular deformable lip projecting circumferentially inwardly at its upper ends at a joint between adjacent sleeve bodies.

* * * * *